US011843155B2

(12) United States Patent
Tageman et al.

(10) Patent No.: US 11,843,155 B2
(45) Date of Patent: Dec. 12, 2023

(54) WAVEGUIDE SECTION AND ARRAY ANTENNA ARRANGEMENT WITH FILTERING PROPERTIES

(71) Applicant: Telefonaktiebolaget LM Ericsson (publ), Stockholm (SE)

(72) Inventors: Ola Tageman, Gothenburg (SE); Sohaib Maalik, Hisings Backa (SE); Anatoli Deleniv, Mölndal (SE)

(73) Assignee: TELEFONAKTIEBOLAGET LM ERICSSON (PUBL), Stockholm (SE)

( * ) Notice: Subject to any disclaimer, the term of this patent is extended or adjusted under 35 U.S.C. 154(b) by 651 days.

(21) Appl. No.: 17/048,526

(22) PCT Filed: Apr. 25, 2018

(86) PCT No.: PCT/EP2018/060521
§ 371 (c)(1),
(2) Date: Oct. 16, 2020

(87) PCT Pub. No.: WO2019/206407
PCT Pub. Date: Oct. 31, 2019

(65) Prior Publication Data

US 2021/0175593 A1 Jun. 10, 2021

(51) Int. Cl.
*H01P 1/20* (2006.01)
*H01P 3/123* (2006.01)
(Continued)

(52) U.S. Cl.
CPC ..... *H01P 3/123* (2013.01); *H01P 1/207* (2013.01); *H01P 11/002* (2013.01);
(Continued)

(58) Field of Classification Search
CPC .. H01P 3/12; H01P 1/20; H01Q 13/02; H01Q 21/0037–005
See application file for complete search history.

(56) References Cited

U.S. PATENT DOCUMENTS 6,271,799 B1 8/2001 Rief et al.
6,603,438 B2 8/2003 Strickland
(Continued)

FOREIGN PATENT DOCUMENTS

CA 2942617 A1 3/2017
EP 0646981 A2 4/1995
(Continued)

OTHER PUBLICATIONS

International Search Report and the Written Opinion of the International Searching Authority, issued in corresponding International Application No. PCT/EP2018/060521, dated Dec. 21, 2018, 11 pages.
(Continued)

*Primary Examiner* — Hasan Islam
(74) *Attorney, Agent, or Firm* — Rothwell, Figg, Ernst & Manbeck, P.C.

(57) ABSTRACT

The present disclosure relates to a waveguide section (101) comprising at least one air-filled waveguide conducting tube (104; 104*a*, 104*b*, 104*c*, 104*d*) having a longitudinal extension (L1). Each waveguide conducting tube (104; 104*a*, 104*b*, 104*c*, 104*d*) has an electrically conducting inner wall (106) and comprises at least one set of at least two electrically conducting integrally formed protrusions (107; 107*a*, 107*b*, 107*c*, 107*d*). Each protrusion (107*a*, 107*b*, 107*c*, 107*d*) is electrically conducting and comprises a corresponding plate part (109; 109*a*, 109*b*, 109*c*, 109*d*) that is adapted to form a capacitance (C1, C2, C3, C4; C10; C11) with at least one other plate part in the same set of protrusions (107; 107*a*, 107*b*, 107*c*, 107*d*) for each set of protrusions (107; 107*a*, 107b, 107*c*, 107*d*), whereby an RF, radio frequency, signal passing via a corresponding waveguide conducting tube (104) is arranged to be electromagnetically filtered.

20 Claims, 11 Drawing Sheets

(51) Int. Cl.

| | |
|---|---|
| ***H01P 1/207*** | (2006.01) |
| ***H01P 11/00*** | (2006.01) |
| ***H01Q 13/02*** | (2006.01) |
| ***H01Q 21/00*** | (2006.01) |

(52) U.S. Cl.
CPC ..... *H01P 11/007* (2013.01); *H01Q 13/02* (2013.01); *H01Q 21/0037* (2013.01)

(56) References Cited

U.S. PATENT DOCUMENTS

| | | | | |
|---|---|---|---|---|
| 7,746,190 | B2 | 6/2010 | Vanin et al. | |
| 9,899,716 | B1 * | 2/2018 | Ligander | H01P 1/211 |
| 2012/0218160 | A1 | 8/2012 | Montgomery et al. | |
| 2012/0293282 | A1 | 11/2012 | Frenna | |
| 2016/0056541 | A1 * | 2/2016 | Tageman | H01P 3/16 343/858 |

FOREIGN PATENT DOCUMENTS

| | | | |
|---|---|---|---|
| EP | 0700111 | A1 | 3/1996 |
| JP | S59198002 | A | 11/1984 |

OTHER PUBLICATIONS

Labay et al. "CAD of T-Septum Waveguide Evanescent-Mode Filters" IEEE Transactions on Microwave Theory and Techniques, Apr. 1, 1993, vol. 1, No. 4, pp. 731-733.

* cited by examiner

WAVEGUIDE SECTION AND ARRAY ANTENNA ARRANGEMENT WITH FILTERING PROPERTIES

CROSS REFERENCE TO RELATED APPLICATION

This application is a 35 U.S.C. § 371 National Phase Entry Application from PCT/EP2018/060521, filed Apr. 25, 2018, designating the United States, the disclosure of which is incorporated herein by reference in its entirety.

TECHNICAL FIELD

The present disclosure relates to a waveguide section comprising at least one air-filled waveguide conducting tube, each waveguide conducting tube comprising at least one set of at least two electrically conducting integrally formed protrusions.

BACKGROUND

Antenna elements are devices configured to emit and/or to receive electromagnetic signals such as radio frequency (RF) signals used for wireless communication. Phased antenna arrays are antennas comprising a plurality of antenna elements, by which an antenna radiation pattern can be controlled by changing relative phases and amplitudes of signals fed to the different antenna elements that give benefits such as a combination of large gain and wide area coverage, interference suppression in certain directions, and multi-beam operation. The higher the frequency, the more the antenna elements are generally required.

Filters are needed for suppression of outgoing unwanted emissions and incoming interferers, and in many cases, it is necessary to place filters between the antenna elements and front-end amplifiers. Intermodulation products and noise can for example arise in front-end amplifiers and must be filtered on the way to the antenna. Another example is that for highly integrated circuits, containing up/down-conversion mixers, there is no possibility to break up TX/RX chains and fit low-loss filters along the way, leaving filtering at the antenna the only option. Narrow transitions regions between pass-band and stop-band are typically required, which puts hard requirements on both the design and manufacturing, with regards to sensitivity to tolerances, and associated frequency precision of the transition region.

Practical implementation of signal filtering functions for such antenna elements is a challenging task. High Q-factor, multiple resonators and high precision are required to achieve filters with low loss and strong suppression of frequencies near the operation band where interference or leakage of radio frequency (RF) power may occur. Microstrip and slot resonators are sometimes used to construct filters for antenna elements. However, low Q-factor of the microstrip or slot resonators cause an increased level of insertion loss. Also, traditional filters are typically designed for ideal loads, e.g. 50 ohm frequency independent. When connected to an antenna both pass-band and suppression-characteristics change.

Cost is important when designing antenna elements for use in antenna arrays. Since antenna arrays may comprise hundreds of antenna elements, individual antenna element cost significantly contributes to the total cost of producing the antenna array.

Integration and assembly aspects must also be considered. It is for example difficult to fit separate filters in the form of SMT-components (pick-and place and reflow soldering), since there is no place to put them with antennas on one side of a circuit board and active circuits on the other side.

An aperture mode filter is described in US 2012/0218160, where a waveguide extension to extend an element aperture, and a two-by-two array of quad-ridged waveguide sections connected to a respective at least one waveguide extension. The arrangement is adapted to suppress undesired electromagnetic modes of the antenna, but does not provide means for sufficient filtering. 4-element sub-arrays are assumed which limits the scan range. There is a patch antenna on a dielectric substrate which gives poor Q-value and an assembly of many parts.

Generally, there is a need for an improved filter arrangement that can be used with, or comprise, antenna elements, in particular array antenna elements.

SUMMARY

An object of the present disclosure is to provide improved filter arrangements that can be used with, or comprise, antenna elements, in particular array antenna elements.

This object is achieved by means of a waveguide section comprising at least one air-filled waveguide conducting tube having a longitudinal extension. Each waveguide conducting tube has an electrically conducting inner wall and comprises at least one set of at least two electrically conducting integrally formed protrusions. Each protrusion is electrically conducting and comprises a corresponding plate part that is adapted to form a capacitance with at least one other plate part in the same set of protrusions for each set of protrusions, whereby an RF, radio frequency, signal passing via a corresponding waveguide conducting tube is arranged to be electromagnetically filtered.

This provides advantages regarding enabling use of air filled cavities, thus avoiding dielectric loss, and frequency imprecision due to variation in dielectric permittivity, and enabling manufacturing in one piece.

According to some aspects, each protrusion comprises a corresponding holding part that connects each plate part to the inner wall and forms an inductance. Such a holding part is preferably relatively thin.

This provides advantages regarding enabling LC-resonators with large capacitor plates on top of a holding part with large inductance; for given resonance frequency this provides a small volume resonator.

Forming such sets of protrusions provides advantages regarding enabling large gaps which minimizes losses due to current crowding. Large capacitor gaps, will also improve the tolerance to gap variations on an absolute scale, and thereby minimize frequency imprecision.

According to some aspects, the protrusions in each set of protrusions lie in a corresponding common plane, perpendicular to the longitudinal extension of the waveguide conducting tube. The protrusions in each set of protrusions at least pairwise have the same shape and mirror-symmetrically extend along a corresponding longitudinal extension.

According to some aspects, circumferentially adjacent plate parts comprised in a set of protrusions form capacitances According to some aspects, in each set of protrusions, the protrusions form opposing pairs that have the same shape and symmetrically extend towards each other from the inner wall.

According to some aspects, in each set of protrusions, the circumferentially adjacent plate parts comprise mutually parallel surfaces.

According to some aspects, in each set of protrusions, the protrusions extend towards a central portion of the waveguide conducting tube.

According to some aspects, for each waveguide conducting tube, a plurality of sets of protrusions are formed along the longitudinal extension of the waveguide conducting tube, such that adjacent sets of protrusions along the waveguide conducting tube are electromagnetically coupled.

This provides advantages regarding enabling a plurality of resonators to be formed.

According to some aspects, each set of protrusions formed along the longitudinal extension of the waveguide conducting tube is separated from adjacent sets of protrusions or other surrounding structures by a reduction of the cross section area of the inner wall of the waveguide conducting tube acting to reduce the coupling to adjacent sets of protrusions or other surrounding structures.

This provides advantages regarding reduction of coupling to adjacent sets of protrusions or other surrounding structures. This enables a size reduction along the longitudinal direction.

According to some aspects, the waveguide section comprises an antenna section, the antenna section being arranged to interface with a transmission medium for transmission and reception of RF waveforms.

This provides advantages regarding enabling a single piece antenna solution that eliminates interfaces and associated tolerance issues between filter and antenna.

According to some aspects, the antenna section comprises one antenna for each waveguide conducting tube, whereby a radio frequency signal comprised in a radio frequency band passing to or from each antenna via the corresponding waveguide conducting tube is arranged to be electromagnetically filtered.

This provides advantages regarding enabling a single piece antenna solution with filtering properties that eliminates interfaces and associated tolerance issues between filter and antenna.

According to some aspects, each antenna is formed at a corresponding end part that comprises an opening and a closest set of protrusions that form radiators, where the open end is positioned a certain distance from the closest set of protrusions.

According to some aspects, each antenna is formed at a corresponding end part where the closest set of protrusions comprises plate parts that are tapered and meet the electrically conducting inner wall at the opening.

This provides advantages regarding enabling many different antenna solutions.

This object is also achieved by means of an array antenna arrangement that comprises a waveguide section that in turn comprises an antenna section according to the above. The array antenna arrangement comprises a feed arrangement adapted to feed the waveguide section, enabling each waveguide conducting tube to interface with external RF, radio frequency, circuitry.

This provides advantages regarding providing an array antenna with the advantages according to the above.

According to some aspects, the feed arrangement comprises a multi-layer printed circuit board, PCB, that is mounted to a first end of the waveguide section, opposite a second end of the waveguide section, where the second end comprises the antenna section.

This provides advantages regarding uncomplicated assembly of the waveguide section onto the PCB. There is a low sensitivity to misalignment in the assembly, where the assembly is suitable for surface mount assembly with reflow soldering.

According to some aspects, the PCB comprises at least one signal layer and a ground plane facing and contacting the waveguide section, where the ground plane comprises at least one aperture for each waveguide conducting tube. The signal layer comprises at least one feeding conductor adapted for feeding the apertures via at least one feed probe.

According to some aspects, the PCB comprises at least one signal layer and a ground plane facing and contacting the waveguide section, where the ground plane comprises an isolated patch element for each waveguide conducting tube. The signal layer comprises at least one feeding conductor adapted for feeding each patch element via at least one feed probe.

According to some aspects, the PCB comprises at least one signal layer and a ground plane facing and contacting the waveguide section, where said signal layer comprises at least one feeding conductor connected to at least one electrically conducting feed probe that extends to the closest set of protrusions and is electrically connected to these protrusion.

This provides advantages regarding enabling a plurality of different feeding arrangements.

This object is also achieved by means of a method for manufacturing an array antenna arrangement according to the above, where the method comprises using 3D-printing, either direct or indirect with a printed mold, to manufacture a waveguide section according to the above. The method further comprises attaching the waveguide section to a multi-layer PCB and attaching radio frequency, RF, circuitry to the PCB.

This provides advantages regarding enabling manufacturing of an air-filled array antenna in one piece.

BRIEF DESCRIPTION OF THE DRAWINGS

Further objects, features, and advantages of the present disclosure will appear from the following detailed description, wherein some aspects of the disclosure will be described in more detail with reference to the accompanying drawings, in which.

DETAILED DESCRIPTION

The inventive concept will now be described more fully hereinafter with reference to the accompanying drawings, in which certain embodiments of the inventive concept are shown. This inventive concept may, however, be embodied in many different forms and should not be construed as limited to the embodiments set forth herein; rather, these embodiments are provided by way of example so that this disclosure will be thorough and complete, and will fully convey the scope of the inventive concept to those skilled in the art. Like numbers refer to like elements throughout the description. Any step or feature illustrated by dashed lines should be regarded as optional.

Figure 1:
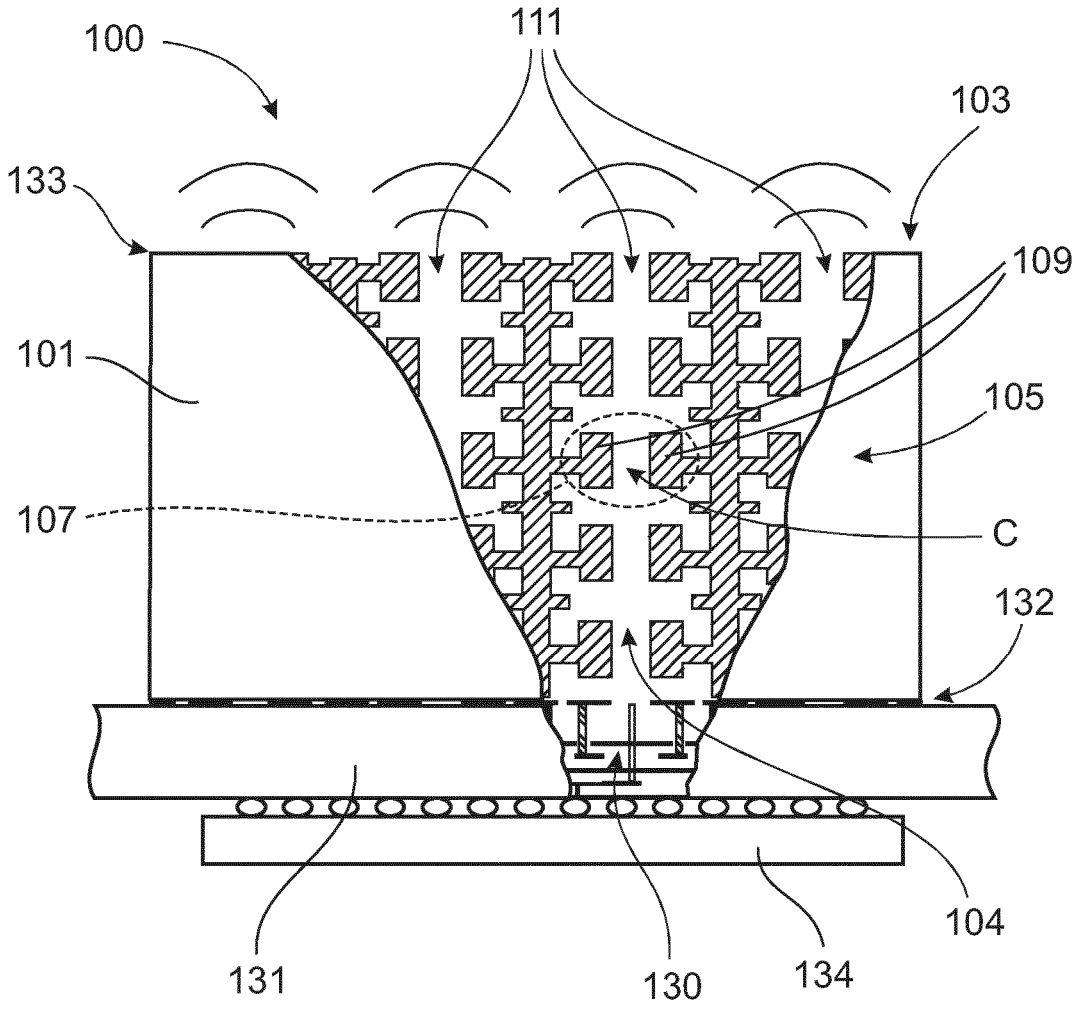
FIG. 1 schematically shows a broken side-view of an array antenna arrangement.

With reference to FIG. 1 showing a broken side-view of an array antenna arrangement, there is a waveguide section 101 comprising a plurality of air-filled waveguide conducting tubes 104. Each waveguide conducting tube 104 comprising a plurality of sets of electrically conducting integrally formed protrusions 107, where each protrusion is electrically conducting. According to the present disclosure, each protrusion comprises a corresponding plate part 109 that is adapted to form a capacitance C with at least one other plate part in each set of protrusions 107.

Figure 2:
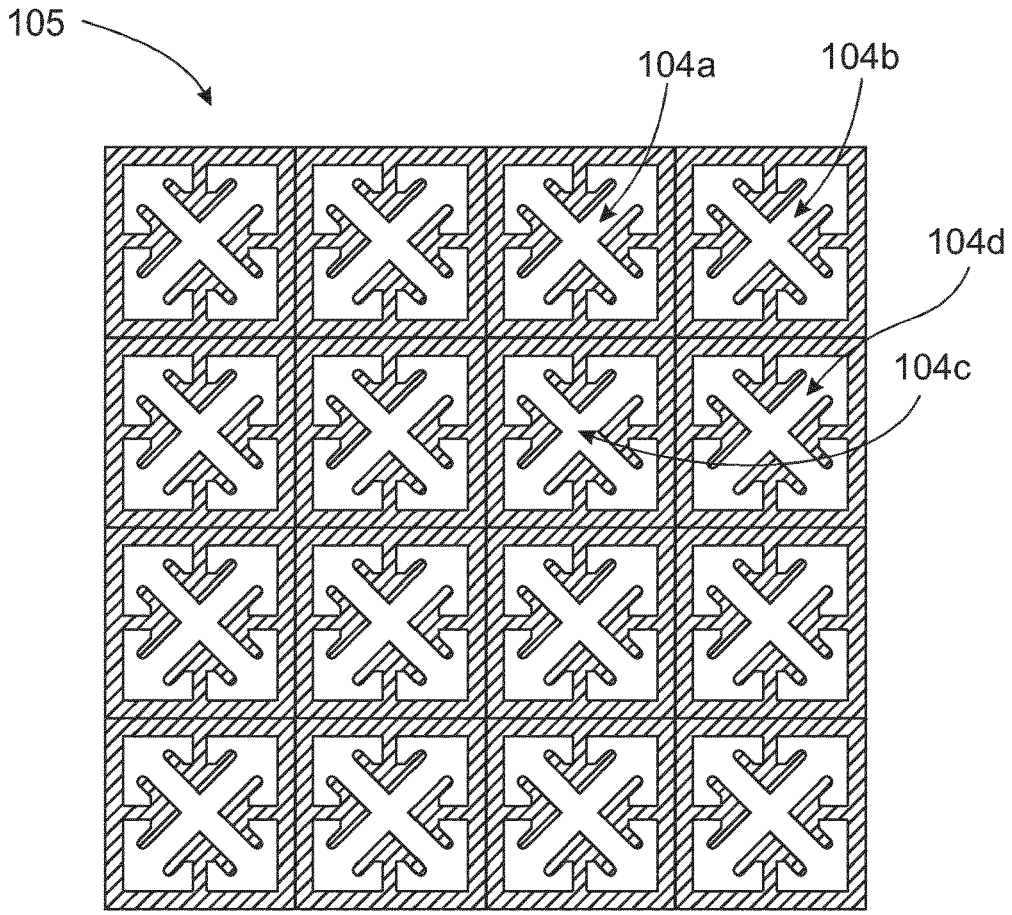
FIG. 2 schematically shows a top view of a waveguide section.

With reference also to FIG. 2, showing a top view of the waveguide section 101, there are sixteen waveguide conducting tubes 104*a*, 104*b*, 104*c*, 104*d* (only four indicated with reference numbers in FIG. 2 for reasons of clarity).

Figure 3A:
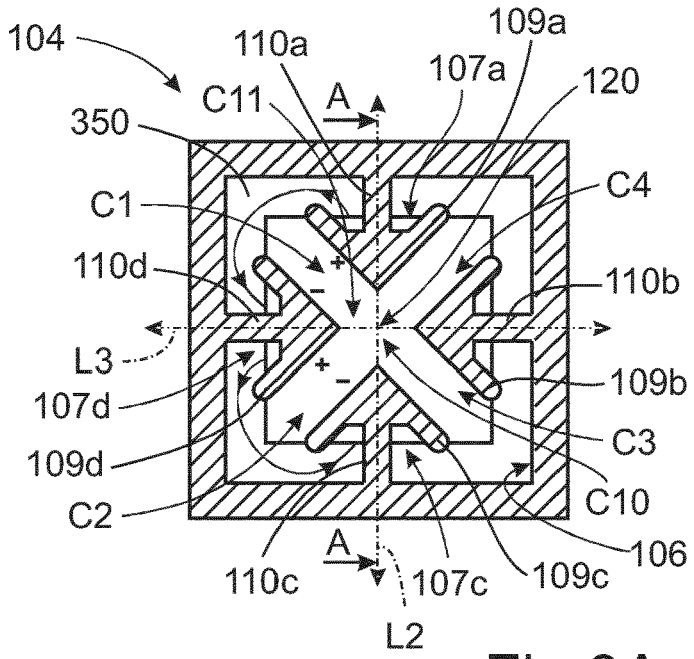
FIG. 3A schematically shows a section through one set of protrusions.

With reference also to FIG. 3A, showing a section through one set of protrusions for one waveguide conducting tube 104 that is typical for all waveguide tubes in the waveguide section, each set of protrusions 107*a*, 107*b*, 107*c*, 107*d* comprises four protrusions 107*a*, 107*b*, 107*c*, 107*d* that pairwise protrude mirror-symmetrically towards each other. Each protrusion comprises an arrow-shaped plate part 109*a*, 109*b*, 109*c*, 109*d* that in accordance with the present disclosure is adapted to form a capacitance C1, C2, C3, C4 with each one of the two adjacent plate parts. Each plate part forming two capacitances is due to the arrow-shape that admits two separate contact surfaces of each plate part 109*a*, 109*b*, 109*c*, 109*d*.

Thus, in this example, circumferentially adjacent plate parts comprised in a set of protrusions 107*a*, 107*b*, 107*c*, 107*d* form capacitances C1, C2, C3, C4, where these plate parts 109*a*, 109*b*, 109*c*, 109*d* comprise mutually parallel surfaces.

The waveguide conducting tube 104 has an electrically conducting inner wall 106 where each protrusion 107*a*, 107*b*, 107*c*, 107*d* comprises a corresponding holding part 110*a*, 110*b*, 110*c*, 110*d* that connects each plate part 109*a*, 109*b*, 109*c*, 109*d* to the inner wall 106 and forms an inductance. By means of the protrusions 107*a*, 107*b*, 107*c*, 107*d* described, a radio frequency signal passing via a corresponding waveguide conducting tube 104 is arranged to be electromagnetically filtered, each set of protrusions 107*a*, 107*b*, 107*c*, 107*d* functioning as one resonator for each supported polarization. Such a resonator can be used in a filter or matching network. A matching network is normally used to improve the matching over a minimum bandwidth, while a filter is used to block certain frequency components while letting other certain frequency components pass.

Capacitance charging will occur in the gap between different plate parts 109*a*, 109*b*, 109*c*, 109*d*, by increasing the area of the plate parts 109*a*, 109*b*, 109*c*, 109*d*, capacitance is increased. By reducing the cross-section area of the holding parts 110*a*, 110*b*, 110*c*, 110*d*, the inductance is increased. Both these features act to bring down the resonance frequency without a need for large volume resonators or narrow gaps. Small size resonators result in a small waveguide conducting tube 104 and small waveguide section 101, and wide gaps lead to reduced tolerance sensitivity.

Figure 3B:
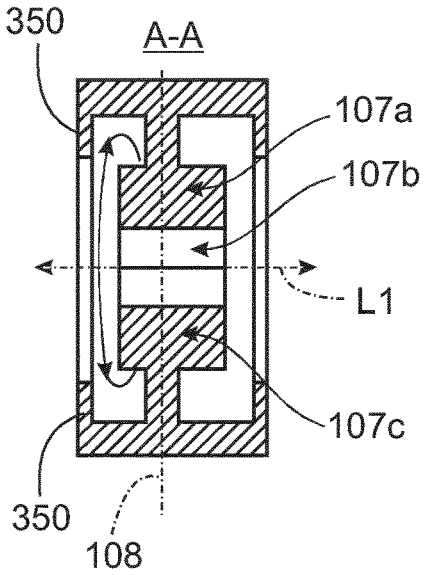
FIG. 3B schematically shows a longitudinal section of the set of protrusions in FIG. 3A.

With reference also to FIG. 3B that shows a longitudinal section of the set of protrusions 107*a*, 107*b*, 107*c*, 107*d* shown in FIG. 3A, each set of protrusions 107*a*, 107*b*, 107*c*, 107*d* lie in a corresponding common plane 108, perpendicular to a longitudinal extension L1 of the waveguide conducting tube 104. The protrusions 107*a*, 107*b*, 107*c*, 107*d* in each set at least pairwise have the same shape and mirror-symmetrically extend along a corresponding first longitudinal extension L2 and second longitudinal extension L3.

Figure 3C:
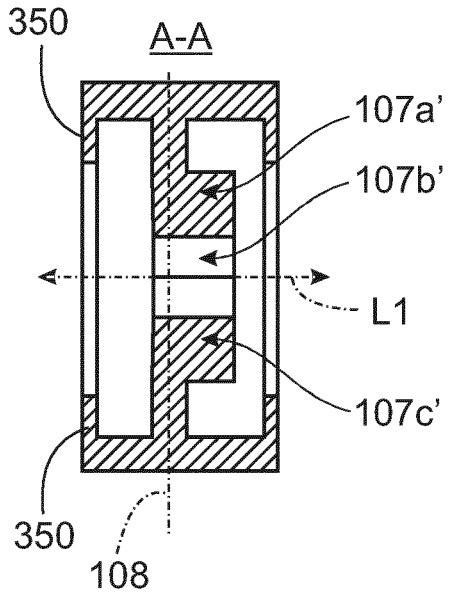
FIG. 3C schematically shows another example of a longitudinal section of the set of protrusions in FIG. 3A.

FIG. 3C shows a view corresponding to FIG. 3B, here an alternative shape of the protrusions 107*a*', 107*b*', 107*c*', 107*d*' is disclosed.

Figure 3D:
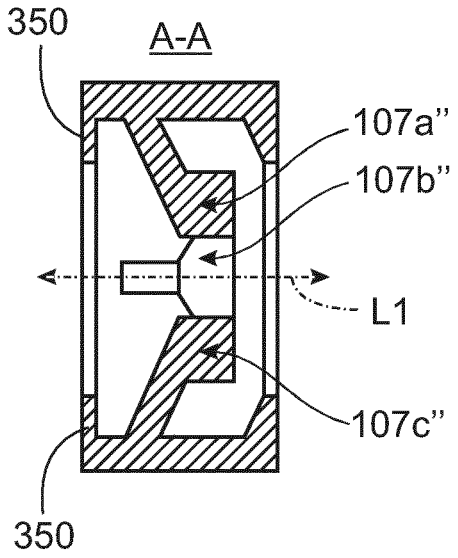
FIG. 3D schematically shows another example of a longitudinal section of the set of protrusions in FIG. 3A.

FIG. 3D shows a view corresponding to FIG. 3B, here a further alternative shape of the protrusions 107*a*", 107*b*", 107*c*", 107*d*" is disclosed.

Figure 4:
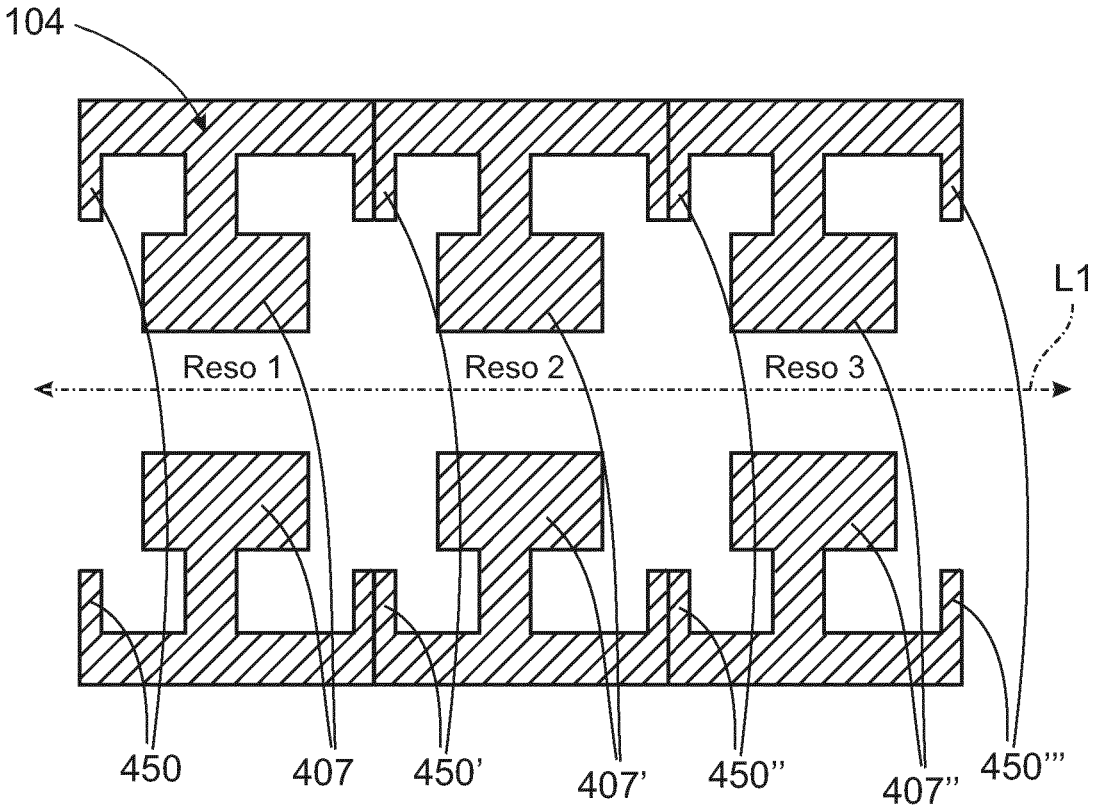
FIG. 4 schematically shows an extended view of FIG. 3B.

FIG. 4 shows an extended view of FIG. 3B, where three sets of protrusions 407, 407', 407" are shown, where each set of protrusions 407, 407', 407" is formed along the longitudinal extension L1 of the waveguide conducting tube 104. Adjacent sets of protrusions are electromagnetically coupled. By changing the separation between adjacent sets of protrusions, the coupling strength can be varied. This is an important parameter to tune when tuning the filter to a desired frequency response.

According to some aspects, each set of protrusions 407, 407', 407" is separated from an adjacent set of protrusions by a corresponding iris arrangement 450, 450', 450", 450'". An iris arrangement is constituted by a limitation in the form of a partial electrically conducting wall partially closing the waveguide conducting tube 104; one iris arrangement 350 is also shown in FIG. 3A and FIG. 3B. As shown in FIG. 3A and FIG. 3B, the iris arrangement 350 runs along the circumference of the inner wall 106, defining an opening. According to some aspects, the opening is quadratic.

The purpose of iris arrangements 450, 450', 450", 450'" is to increase the isolation between the sets of protrusions 407, 407', 407" that act as resonators, which allows a reduced spacing between the sets of protrusions 407, 407', 407" for a given coupling strength. Reduced spacing implies smaller overall length.

Figure 5:
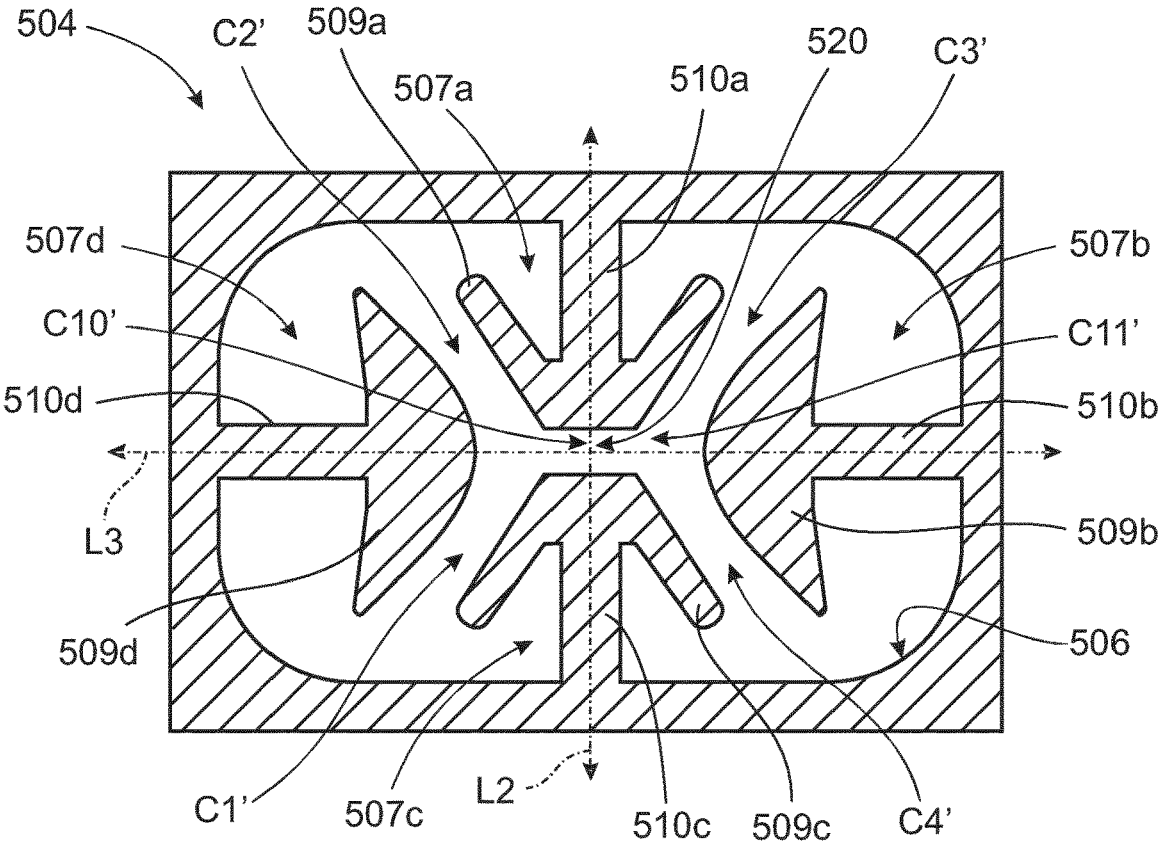
FIG. 5 schematically shows a section through one set of protrusions according to an example.

Irises can be used not only between sets of protrusions. One example is at the input end of a filter where irises can be used on both sides while there is a neighboring set of protrusions only on one side. The use of irises will provide a compact resonator with an electromagnetic field well confined near the set of protrusions. This will reduce loss due to unwanted coupling to any lossy structures in the surroundings, for example in the feed arrangement, and thus improve the Q-value of the resonator. Another example is when a single resonator is used, where irises can be used to get a compact resonator with large Q-value With reference to FIG. 5, showing a section through one set of protrusions for one waveguide conducting tube 504 that is typical for all waveguide tubes in the waveguide section, an alternative set of protrusions is shown. The protrusions form opposing pairs 507*a*, 507*c*; 507*b*, 507*d* that have the same shape and mirror-symmetrically extend towards each other from the inner wall 506. Here, two opposing protrusion in a first pair 507*a*, 507*c* still have an arrow-shape, and being constituted by a holding part 510*a*, 510*c* and a plate part 509*a*, 509*c*, where the plate parts 509*a*, 509*c* have flat arrow tips. Two opposing protrusion in a second pair 507*b*, 507*d* have a smooth arrow-shape or mushroom-shape, and being constituted by a holding part 510*b*, 510*d* and a plate part 509*b*, 509*d*, where the plate parts 509*b*, 509*d* have a mushroom-shape.

Thus, in this example, circumferentially adjacent plate parts comprised in a set of protrusions 507*a*, 507*c*; 507*b*, 507*d* at least partly form capacitances C1', C2', C3', C4'.

Figure 6:
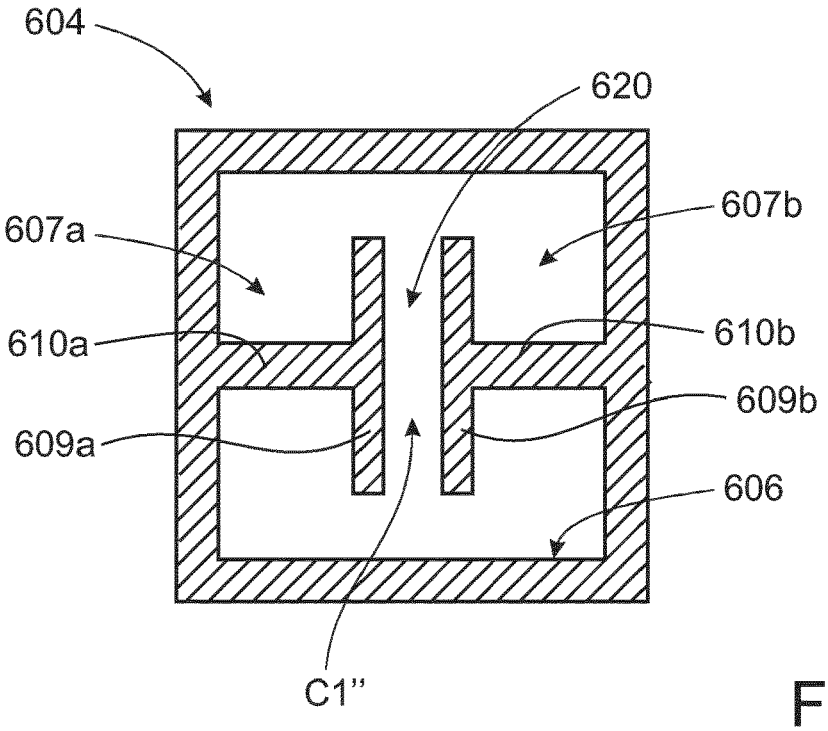
FIG. 6 schematically shows a section through one set of protrusions according to an example.

With reference to FIG. 6, showing a section through one set of protrusions for one waveguide conducting tube 604 that is typical for all, or at least a plurality of, waveguide tubes in the waveguide section, an alternative set of protrusions is shown. The protrusions are T-shaped and form one opposing pair 607*a*, 607*b* that have the same shape and mirror-symmetrically extend towards each other from the inner wall 606. Here, two opposing protrusion form a pair 607*a*, 607*b*, each protrusion being constituted by a holding part 610*a*, 610*b* and a plate part 609*a*, 609*b*, where the plate parts 609*a*, 609*b* have flat opposing surfaces that form a capacitance C1" between them.

Thus, in this example, circumferentially adjacent plate parts comprised in a set of protrusions 607*a*, 607*b* at least partly form a capacitance C1". It should be noted that the examples described with reference to FIG. 2-5 support dual polarization, while the example described with reference to FIG. 6 supports single polarization only.

In all examples, in each set of protrusions 107*a*, 107*c*; 107*b*, 107*d*; 507*a*, 507*c*; 507*b*, 507*d*; 607*a*, 607*b*, the of protrusions 107*a*, 107*c*; 107*b*, 107*d*; 507*a*, 507*c*; 507*b*, 507*d*; 607*a*, 607*b* extend towards a central portion 120, 520, 620 of the waveguide conducting tube 104, 504, 604.

As shown in FIG. 1, according to some aspects, the waveguide section 101 comprises an antenna section 103 that can be regarded as an antenna functionality and is arranged to interface with a transmission medium for transmission and reception of RF (radio frequency) waveforms. The antenna section 103 comprises one antenna 111 for each waveguide conducting tube 104, and by means of the waveguide section 101, a radio frequency signal comprised in a radio frequency band passing to or from each antenna 111 via the corresponding waveguide conducting tube 104 is arranged to be electromagnetically filtered.

Generally, an antenna can be formed by any type of waveguide tube opening. An antenna can furthermore be in the form of a set of protrusions at an open end of a waveguide conducting tube 104. Such protrusions can be similar to those used for filtering, and should be tuned to resonate in or near the desired operating band. Radiation is mainly excited by the E-field between the plate parts. Examples of antennas will be provided below.

Figure 7:
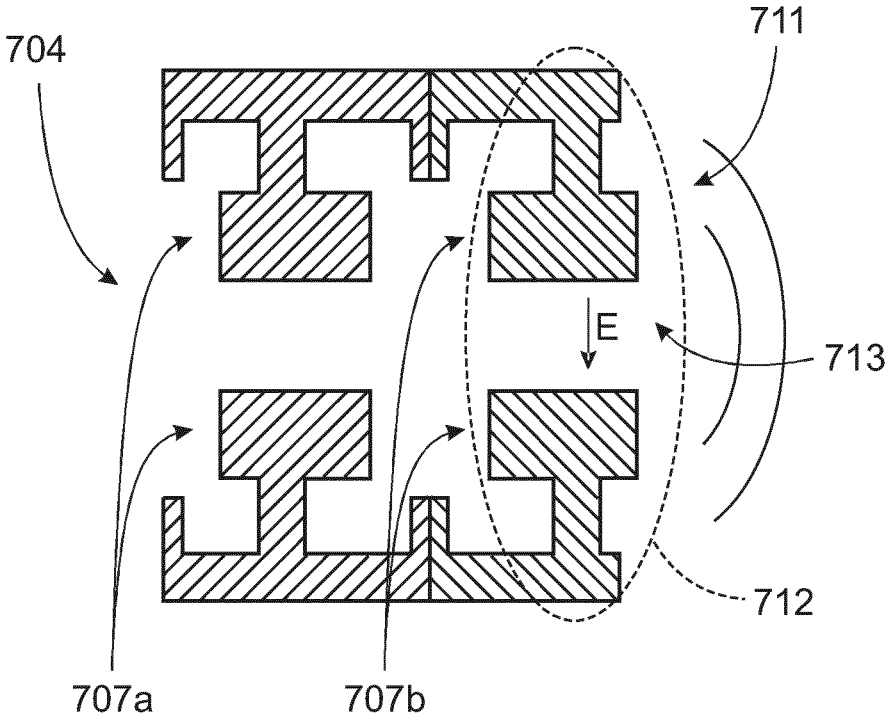
FIG. 7 schematically shows a section showing an example of the antenna section for one waveguide conducting tube.
Figure 8:
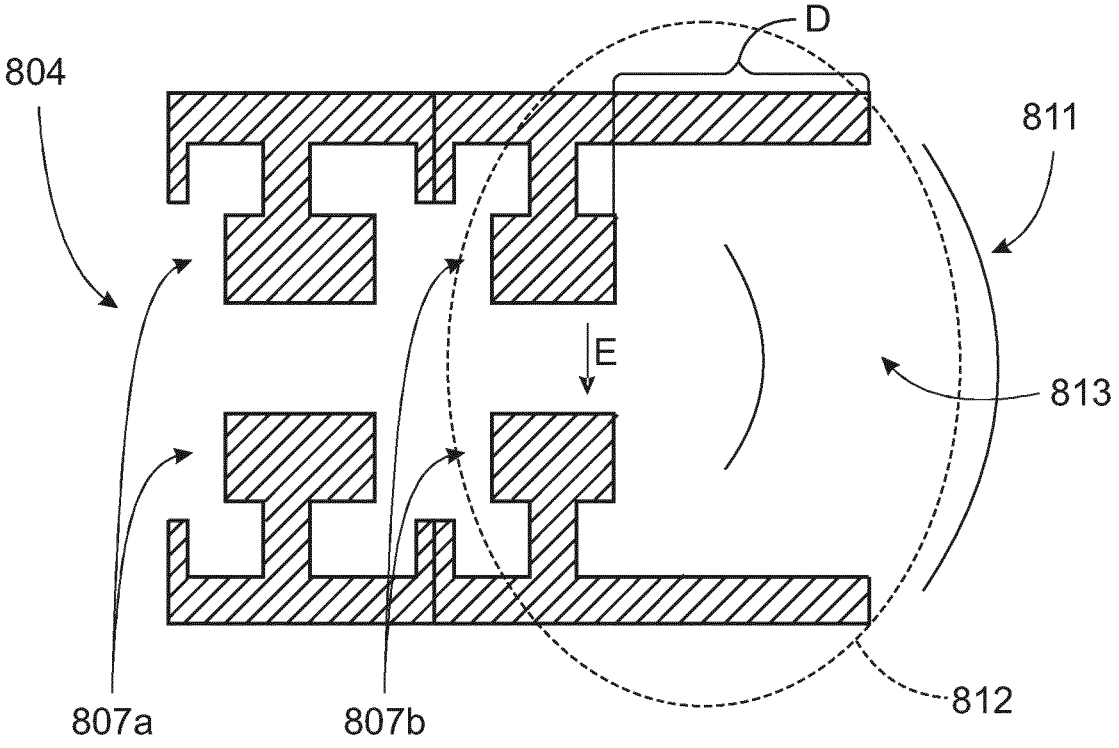
FIG. 8 schematically shows a section showing an example of the antenna section for one waveguide conducting tube.
Figure 9:
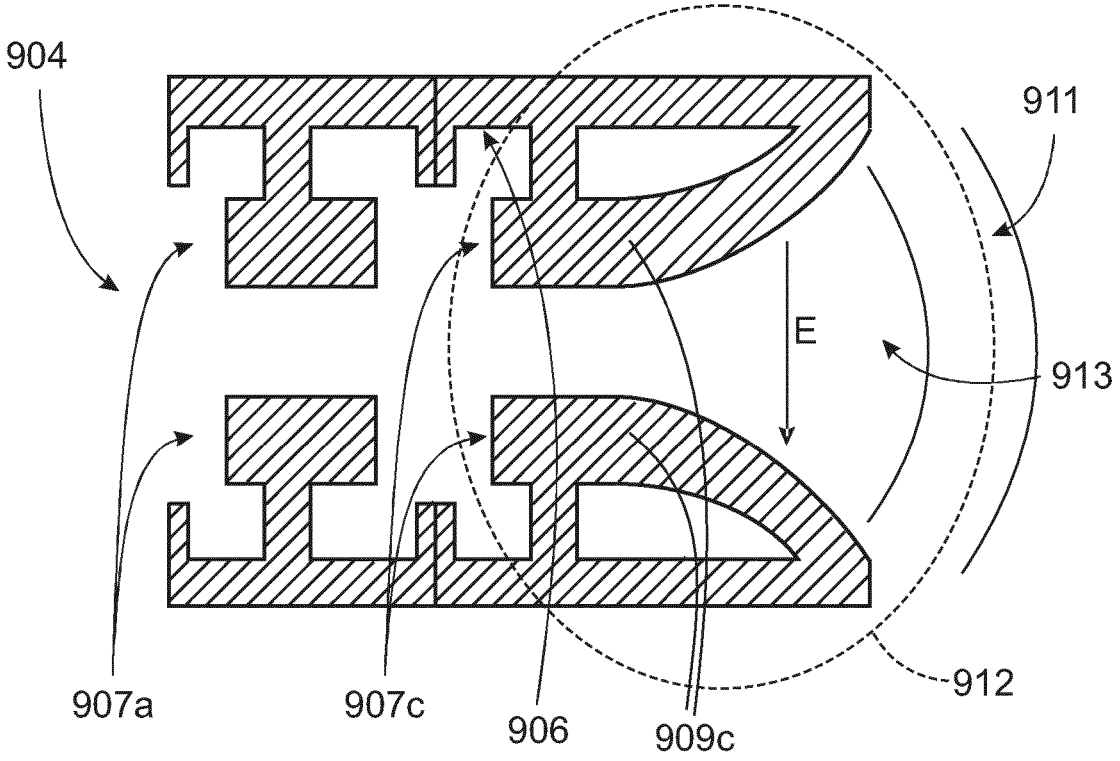
FIG. 9 schematically shows a section showing an example of the antenna section for one waveguide conducting tube.

FIG. 7, FIG. 8 and FIG. 9 show a corresponding section showing the antenna section 103 for one waveguide conducting tube 704, 804, 904 that is typical for all, or at least a plurality of, waveguide tubes 104 in the waveguide section 101. Two sets of protrusions 707*a*, 707*b*; 807*a*, 807*b*; 907*a*, 907*b* are shown With reference to FIG. 7 and FIG. 8, each antenna 711, 811 is formed at a corresponding end part 712, 812 that comprises an opening 713, 813 and a closest set of protrusions 707*b*, 807*b* that form radiators. The opening 713, 813 is positioned at a certain distance D from the closest set of protrusions 707*b*, 807*b*, where the distance D can be zero as shown in FIG. 7.

With reference to FIG. 9, each antenna 911 is formed at a corresponding end part 912 where the closest set of protrusions 907*c* comprises radiating plate parts 909*c* that are tapered and meet the electrically conducting inner wall at the opening 913.

According to some aspects, the set of protrusions that constitute a radiator can have a ground wall that extends beyond said set of protrusions. This can be used to control the coupling strength out into air, or it can be used to create an additional resonator box. To bring the resonance frequency of such a box resonance down to the desired operating band one can according to some aspects add a dielectric filling or accept a center-to-center distance between adjacent antenna elements larger than half wavelength.

As shown in FIG. 1, the waveguide section 101 together with a feed arrangement 130 forms an array antenna arrangement 100. The feed arrangement 130 is adapted to feed the waveguide section 101, enabling each waveguide conducting tube 104 to interface with external radio frequency (RF) circuitry 134 positioned outside the waveguide section. For this purpose, the waveguide section 101 comprises a plurality of waveguide conducting tubes 104, according to some aspects at least four waveguide conducting tubes, forming a waveguide array 105.

The feed arrangement comprises a multi-layer printed circuit board 131 (PCB) that is mounted to a first end 132 of the waveguide section 101, opposite a second end 133 of the waveguide section, where the antenna section 103 is located at the second end 133. The interface between the waveguide section and the PCB should be electrically conducting either by means of galvanic connection or by means of contactless coupling across a narrow gap.

Figure 10B:
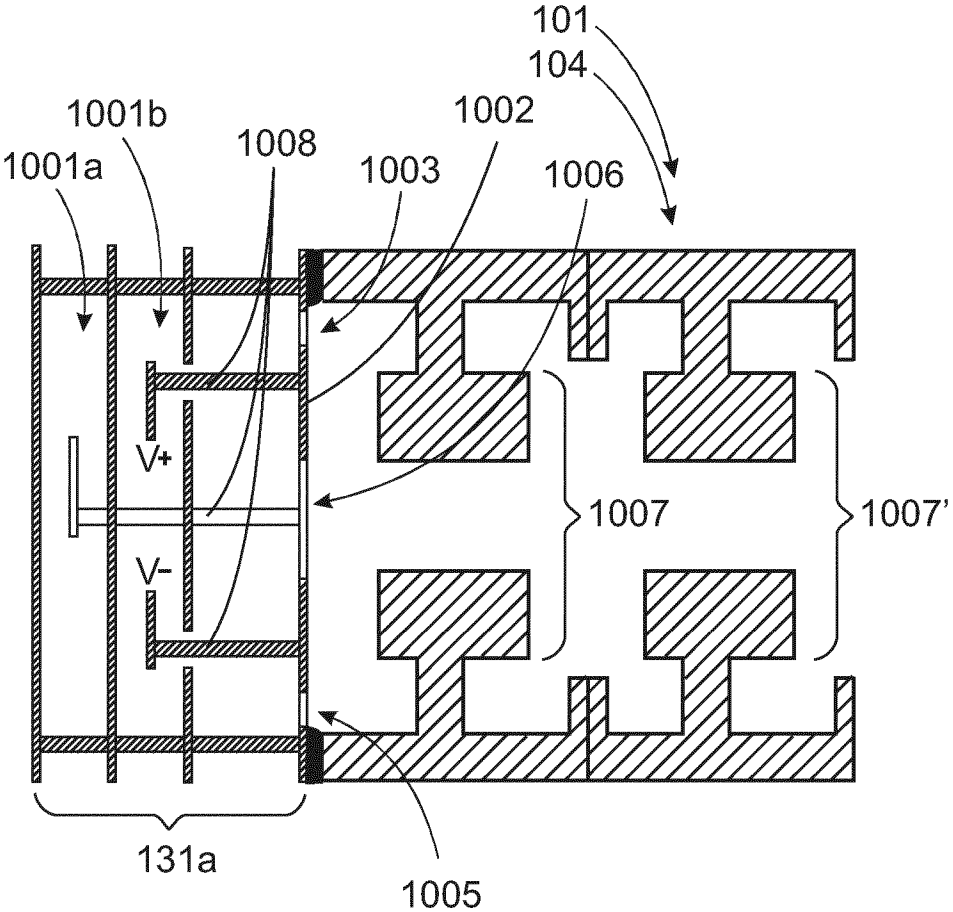
FIG. 10B schematically shows a section of an example of a feeding arrangement that is mounted to a waveguide conducting tube.
Figure 10A:
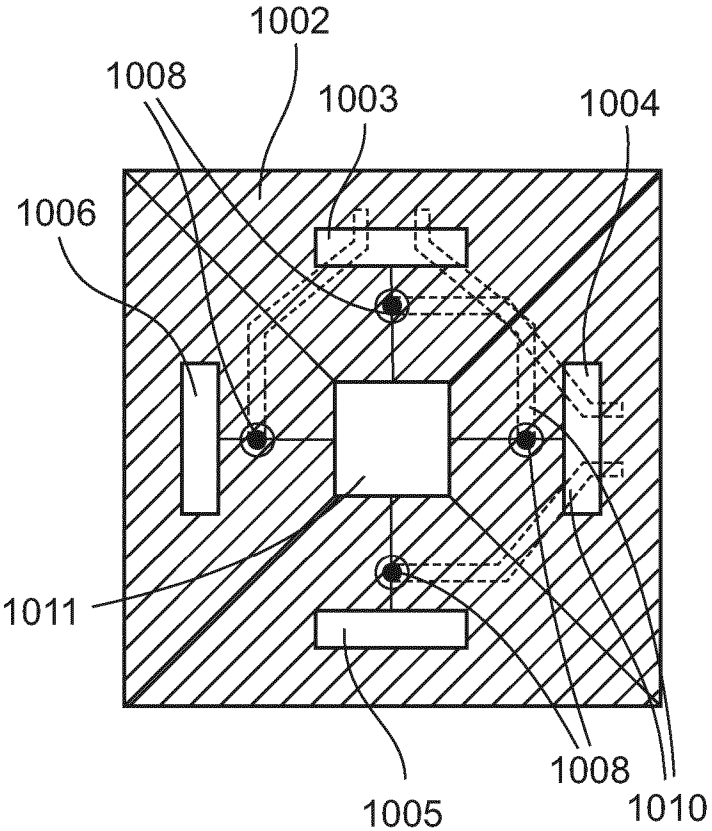
FIG. 10A schematically shows a top view of an example of a feeding arrangement.
Figure 11B:
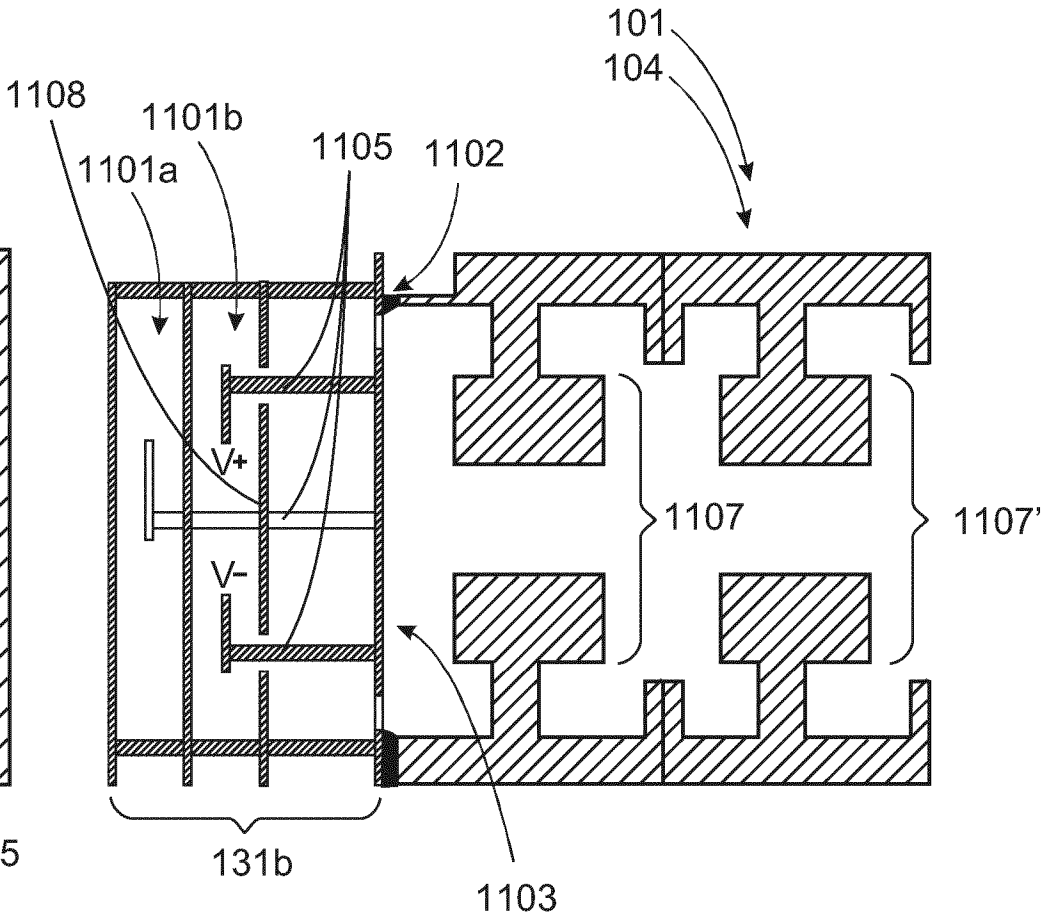
FIG. 11B schematically shows a section of an example of a feeding arrangement that is mounted to a waveguide conducting tube.
Figure 11A:
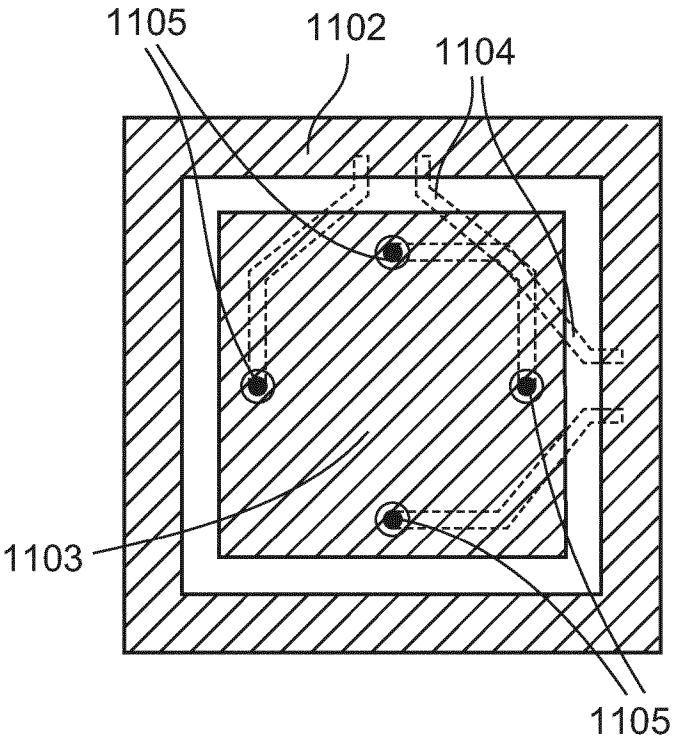
FIG. 11A schematically shows a top view of an example of a feeding arrangement.
Figure 12B:
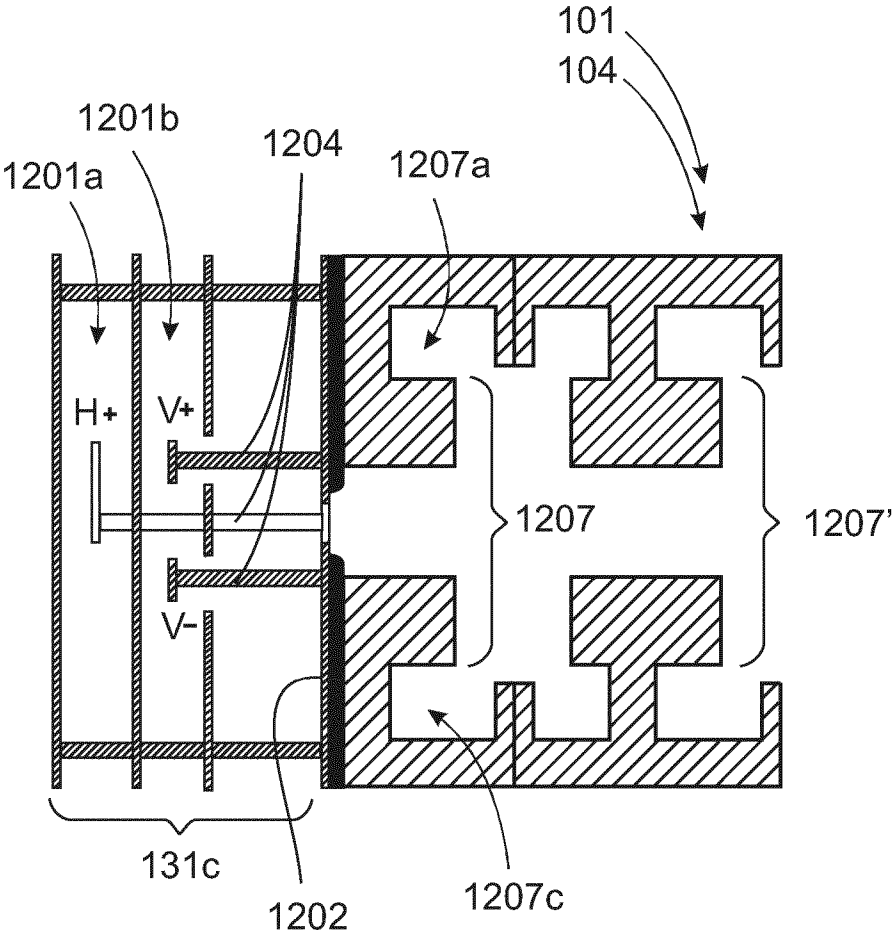
FIG. 12B schematically shows a section of an example of a feeding arrangement that is mounted to a waveguide conducting tube.
Figure 12A:
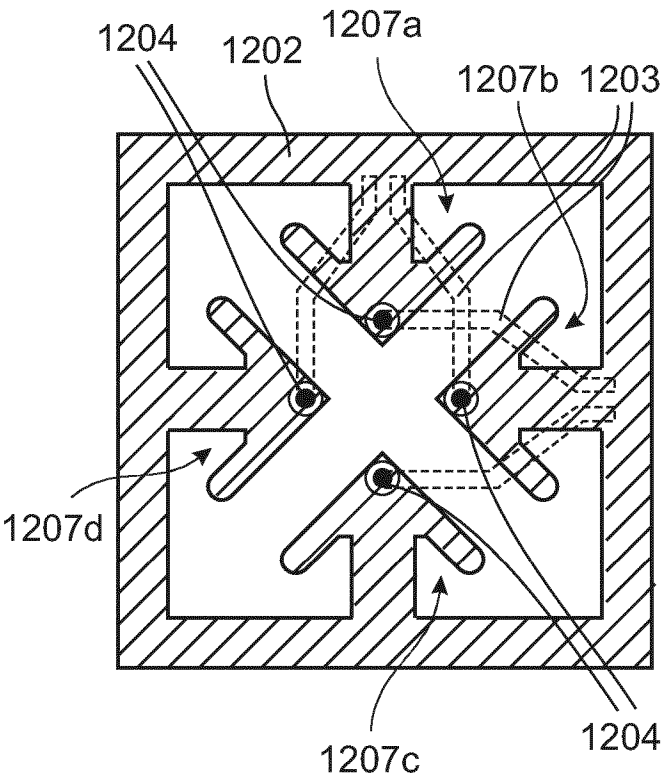
FIG. 12A schematically shows a top view of an example of a feeding arrangement.

FIG. 10A, FIG. 11A and FIG. 12A show a corresponding top view of a feeding arrangement, and FIG. 10B, FIG. 11B and FIG. 12B show a corresponding section of a feeding arrangement that is mounted to the first end 132 of the waveguide section 101 for one waveguide conducting tube 104. The waveguide conducting tube 104 is typical for all, or at least a plurality of, waveguide tubes in the waveguide section 101. Two sets of protrusions 1007, 1007'; 1107, 1107'; 1207, 1207' are shown With reference to FIG. 10A and FIG. 10B, according to some aspects, the PCB 131*a* comprises signal layers 1001*a*, 1001*b* and a ground plane 1002 facing the waveguide section 101. The ground plane 1002 comprises five apertures 1003, 1004, 1005, 1006, 1011 and the signal layers 1001*a*, 1001*b* comprise feeding conductors 1010 (schematically indicated) adapted for feeding the apertures 1003, 1004, 1005, 1006, 1011 via feed probes 1008. The apertures are in turn adapted to feed the waveguide section 101 by exciting the closest set of protrusions 1007. It is not necessary to have all five apertures for example only a central aperture 1011 can either omitted or the only aperture present. There is thus at least one aperture.

Still with reference to FIG. 10A and FIG. 10B, according to some aspects, the PCB comprises a second ground plane and multiple vias that connect the first ground plane and the second ground plane. The first and second ground plane together with the multiple vias create a resonant cavity. The signal layers comprise feeding conductors adapted for feeding the resonant cavity via feed probes. The cavity field leaks through the apertures and excites the closest set of protrusions. There are other ways to excite the apertures in a ground plane, one example is to use a stripline across the aperture.

With reference to FIG. 11A and FIG. 11B, according to some aspects, the PCB 131*b* comprises at least two signal layers 1101*a*, 1101*b* and a first ground plane 1102 facing the waveguide section 101. The ground plane 1102 comprises a patch element 1103 and the signal layers 1001*a*, 1001*b* comprise feeding conductors 1104 (schematically indicated) adapted for feeding the patch element 1103 via feed probes 1105. The patch element 1103 is in turn adapted to feed the waveguide section 101 by exciting the closest set of protrusions 1107. It should be understood that there is a second ground 1108 plane parallel to the first ground plane 1102 and connected to the first ground plane 1102 with multiple vias, the second ground plane 1108 acting as a ground plane for the patch element 1103.

With reference to FIG. 12A and FIG. 12B, according to some aspects, the PCB 131*c* comprises two signal layers 1201*a*, 1201*b* and a ground plane 1202 facing the waveguide section 101. The signal layers 1201*a*, 1201*b* comprise feeding conductors 1203 (schematically indicated) connected to electrically conducting feed probes 1204 that extend to the closest set of protrusions 1207*a*, 1207*b*, 1207*c*, 1207*d* and are electrically connected to these protrusion 1207*a*, 1207*b*, 1207*c*, 1207*d*, enabling direct excitement.

It is desired to have an array antenna geometry with approximately a half wavelength distance center to center between adjacent antenna elements, with every antenna element fed individually. This is enabled by means of the present disclosure as described above, where a single 3D-structured object, creating an array of combined air-filled waveguide tubes that act as filters, and antenna elements that can support dual polarization and be fed from a PCB with RF circuitry 134 on the backside as shown in FIG. 1. An antenna element can support one or two polarizations.

The filters are based on sets of protrusion that form LC resonators with large capacitance plates on top of a relatively thin inductor, constituted by the holding part, for example in the form of quadruple 3D arrow-shaped resonators. For a given resonance frequency, this gives a small volume resonator that can be fitted within the half-wavelength unit cell, and avoids narrow gaps. Irises between resonators make it possible to further reduce the spacing between resonators and to shrink the overall size. The air-filled waveguides provide a high Q-value, since there is no dielectric loss. The antenna elements are integrated with filtering functionality in the waveguide tubes, and several examples for compact feeding to all the RF-chains, still within the half-wavelength distance between adjacent antenna elements, have been described.

The present disclosure is not limited to the above examples, but may vary freely within the scope of the appended claims. For example, the protrusions in a set of protrusion need not lie in the same plane, and need not extend towards a central portion 120, 520, 620 of the waveguide conducting tube. Instead, the protrusions in a set of protrusion can lie at different positions along the a longitudinal extension L1, and can extend in different directions as long as a plate part forms a capacitance with at least one other plate part in each set of protrusions. Along a waveguide conducting tube, different kinds of sets of protrusions can be formed to obtain desired filtering properties.

It is possible to have dielectric filling instead of air, in part or in the entire waveguide, for the purpose of reducing size for example.

The plate parts 109*a*, 109*b*, 109*c*, 109*d* do not have to be exactly flat and mutually co-planar. According to some aspects, the plate parts 109*a*, 109*b*, 109*c*, 109*d* are structured, for example in the form of zig-zag surface following the opposite surface, which increases the effective area, and provides more capacitance and thus smaller size.

In the case of four protrusion in a set, there can be a third capacitance surface in between the two mentioned, a surface facing directly the plate part from the opposite side. This can be used to get different capacitance for the different polarizations.

A set of protrusions can lack rotational symmetry and still provide orthonormality between polarizations.

The waveguide conducting tube can have any suitable cross-section such as for example quadratic, rectangular, circular, elliptic, octagonal and hexagonal. Each waveguide conducting tube can be tuned differently for different polarizations, in terms of bandwidth, center frequency and slopes.

Other symmetries and geometries are conceivable, for example the number of protrusion in each set of protrusion can vary and be 2, 3, 5, 6, 7, 8 and so on.

Figure 13:
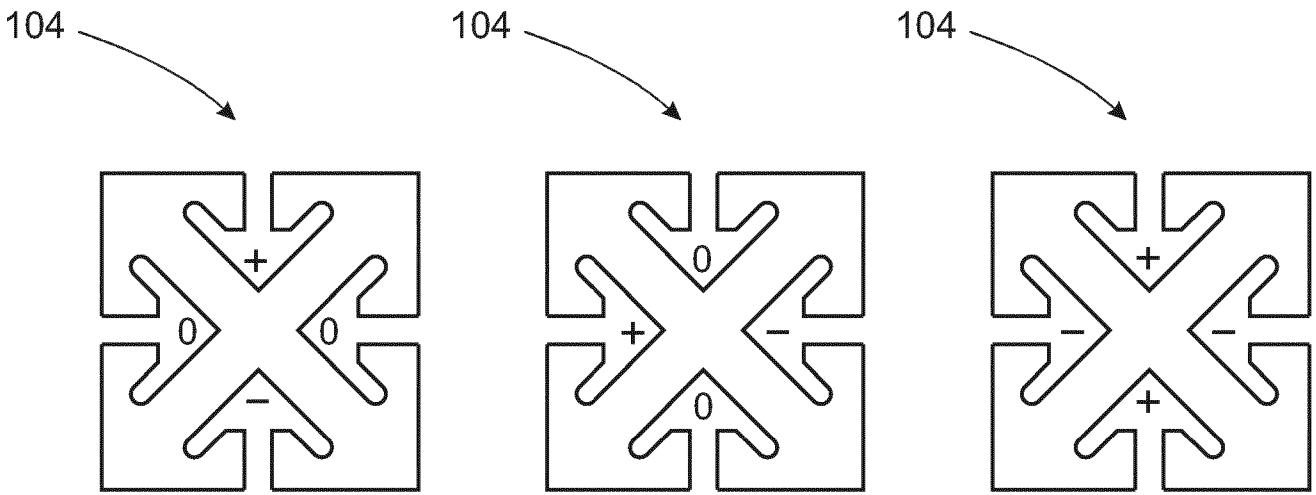
FIG. 13 illustrates three possible resonance modes for a waveguide conducting tube.

With reference to FIG. 13 showing a waveguide conducting tube 104, three resonance modes are supported in the case of four protrusions in a resonator constituted by a set of protrusions; (+0−0), (0+0−) and (+−+−). Even more resonance modes are supported for more protrusions in a set. For dual polarization, the third resonance mode (+−+−) is preferably suppressed.

Excitation of the third resonance mode can be suppressed in different ways. One simple way is to use differential excitation, another way is to add resonators that only support two resonant modes near the passband. Such resonators can be implemented in the PCB, for example as patch resonators or cavity resonators.

In the case of two different polarizations, each polarization can have different filter characteristics, e.g. different center frequencies and bandwidth. This can be achieved by breaking the rotational symmetry. If, for example, the capacitance between two plate parts on opposite sides is increased, then the resonance frequency of the corresponding polarization goes down. Same things happen if the holding part is made longer or thinner. It is possible to have different coupling for the different polarizations, by having different iris widths for the different polarizations, or by changing the position of the holding part. There are many similar possibilities to adjust the geometry for this purpose.

It is also possible to achieve the same passband characteristic for the different polarizations even though each sets of protrusions dos not have rotational symmetry. An elliptical tube can for example be compensated by changes in the plate part size and holding part size.

The feed arrangements can according to some aspects be differential or single ended. For single ended feeding, one trace can be grounded at a suitable distance or omitted, and to suppress cross coupling between polarizations the position of feed traces, feed probe vias, or feed apertures can be adjusted.

Feed arrangements can include resonant structures in the PCB 131 and/or the waveguide section 101. These resonant structures can be used in different ways, for example as resonators in the filter, and increase the order of the filter. For improved frequency precision, the feed arrangement can be tuned for broadband performance by increasing the coupling between resonators in the feed arrangement, and/or by detuning the resonance frequency. Assembly tolerances at the interface between PCB 131 and the waveguide section 101 are expected to be worse than manufacturing tolerances inside the waveguide section 101. In that case it makes sense to tune for a larger bandwidth across this interface.

According to some aspects, there can be a feed arrangement in both ends 132, 133 of each waveguide conducting tube 104, enabling each such waveguide conducting tube 104 to be used as stand-alone filter. It is possible to tune different filters differently and use them in a filter bank, with or without switching networks for selection.

For an array antenna, the center to center distance between adjacent antenna elements can be larger than half wavelength, or smaller. For wideband operation the highest frequencies can give a smaller distance. For some use-cases, with limited scan-range, one can choose to use a larger distance than half wave-length. The disclosed solution can be adapted for any distance of practical interest, through a re-tuning of the capacitance and inductance.

Two or more waveguide conducting tubes can be fed by the same signal by means of splitting in the PCB, or splitting inside the waveguide conducting tube.

The waveguide section 101 can according to some aspects comprise waveguide conducting tubes that are positioned relative to each other according to any pattern such as rectangular, triangular or honeycomb.

According to some aspects, the waveguide section 101 is manufactured by means of additive methods such as 3D-printing. The waveguide section can be printed directly or molded in a 3D-printed mold.

According to some aspects the geometry can be adapted to avoid temporarily isolated islands during the printing procedure, which is necessary for some printing methods. This is exemplified in FIG. 3C, in which it is possible to grow from left to right without temporarily isolated island.

According to some aspects the geometry can be adapted to avoid printing material that is not well supported by previously printed material in the vicinity, which is necessary for some printing methods. This can be achieved by limiting the rate of area increase per layer. An example of this is shown in FIG. 3D.

Figure 14:
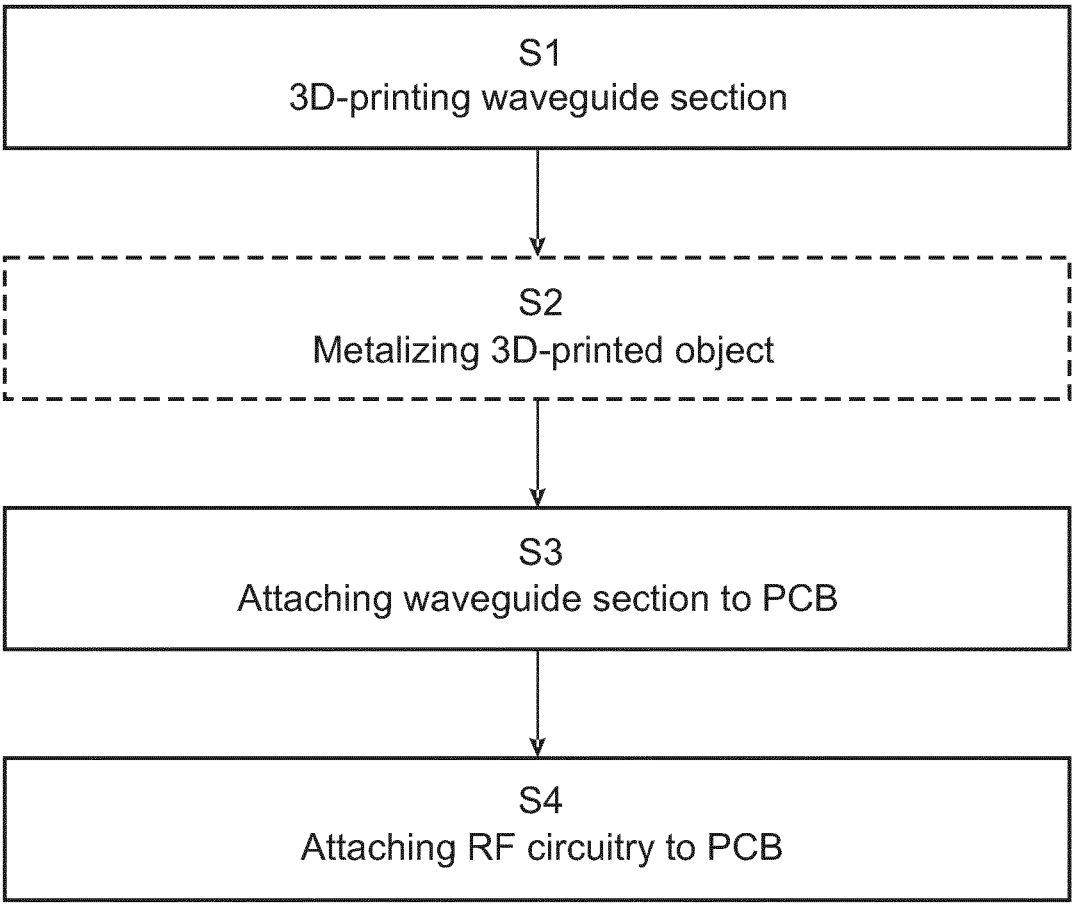
FIG. 14 shows a flowchart for methods according to the present disclosure.

With reference to FIG. 14, the present disclosure also relates to a method for manufacturing an array antenna arrangement 100 as described above, wherein the method comprises:

using S1 3D-printing to manufacture a waveguide section 101 as described above; attaching S3 the waveguide section 101 to a multi-layer printed circuit board 131, PCB; and mounting S4 radio frequency, RF, circuitry 134 to the PCB 131.

According to some aspects, the method comprises metalizing S2 the 3D-printed object in order to obtain an electrically conducting surface. This is necessary if the 3D-printed object originally is made in a non-conductive material such as plastic. This can also be necessary to provide a sufficient surface finish and conductivity even if the 3D-printed object originally is made in a conductive material.

According to some aspects, the waveguide section 101 is manufactured by means of fusion bonding of multiple conductive layers.

According to some aspects, the waveguide section 101 is manufactured as a printed circuit board, using multiple metal layers and vias to build up the shapes. To create air-filling, at least partly one can make un-plated through holes or machined trenches after lamination. Optionally one can use temporary support material which is resolved after lamination.

With reference to FIG. 3A, there are additional opposing capacitances C10, C11 (schematically indicated) formed between opposing plate parts 109*a*, 109*c*; 109*b*, 109*d*. There is a first opposing capacitance C10 formed between opposing plate parts 109*a*, 109*c* along the first longitudinal extension L2 a second opposing capacitance C11 formed between opposing plate parts 109*b*, 109*d*, along the second longitudinal extension L3. Corresponding opposing capacitances C10', C11' are present in the example described with reference to FIG. 5. Here, it is possible to increase a first opposing capacitance C10' while decreasing a second opposing capacitance C11', and vice versa. With reference to FIG. 6, if only two protrusions are used, an opposing capacitance C1" is the only capacitance remaining.

Generally, the present disclosure relates to a waveguide section 101 comprising at least one air-filled waveguide conducting tube 104; 104*a*, 104*b*, 104*c*, 104*d* having a longitudinal extension L1, each waveguide conducting tube 104; 104*a*, 104*b*, 104*c*, 104*d* having an electrically conducting inner wall 106 and comprising at least one set of at least two electrically conducting integrally formed protrusions 107; 107*a*, 107*b*, 107*c*, 107*d*, wherein each protrusion 107*a*, 107*b*, 107*c*, 107*d* is electrically conducting and comprises a corresponding plate part 109; 109*a*, 109*b*, 109*c*, 109*d* that is adapted to form a capacitance C1, C2, C3, C4; C10; C11 with at least one other plate part in the same set of protrusions 107; 107*a*, 107*b*, 107*c*, 107*d* for each set of protrusions 107; 107*a*, 107*b*, 107*c*, 107*d*, whereby an RF, radio frequency, signal passing via a corresponding waveguide conducting tube 104 is arranged to be electromagnetically filtered.

According to some aspects, each protrusion 107*a*, 107*b*, 107*c*, 107*d* comprises a corresponding holding part 110*a*, 110*b*, 110*c*, 110*d* that connects each plate part 109*a*, 109*b*, 109*c*, 109*d* to the inner wall 106 and forms an inductance.

According to some aspects, the protrusions 107*a*, 107*b*, 107*c*, 107*d* in each set of protrusions 107*a*, 107*b*, 107*c*, 107*d* lie in a corresponding common plane 108, perpendicular to the longitudinal extension L1 of the waveguide conducting tube 104, and where the protrusions 107*a*, 107*b*, 107*c*, 107*d* in each set of protrusions 107*a*, 107*b*, 107*c*, 107*d* at least pairwise have the same shape and mirror-symmetrically extend along a corresponding longitudinal extension L2, L3.

According to some aspects, circumferentially adjacent plate parts comprised in a set of protrusions 107*a*, 107*b*, 107*c*, 107*d* form capacitances C1, C2, C3, C4.

According to some aspects, in each set of protrusions, the protrusions form opposing pairs 107*a*, 107*c*; 107*b*, 107*d*; 507*a*, 507*c*; 507*b*, 507*d*; 607*a*, 607*b* that have the same shape and symmetrically extend towards each other from the inner wall 106, 506, 606.

According to some aspects, in each set of protrusions 107*a*, 107*b*, 107*c*, 107*d*; 607*a*, 607*b*, the circumferentially adjacent plate parts 109*a*, 109*b*, 109*c*, 109*d*; 609*a*, 609*b* comprise mutually parallel surfaces.

According to some aspects, in each set of protrusions 107*a*, 107*c*; 107*b*, 107*d*; 507*a*, 507*c*; 507*b*, 507*d*; 607*a*, 607*b*, the protrusions extend towards a central portion 120, 520, 620 of the waveguide conducting tube 104, 504, 604.

According to some aspects, for each waveguide conducting tube 104, a plurality of sets of protrusions 407, 407', 407" are formed along the longitudinal extension L1 of the waveguide conducting tube 104, such that adjacent sets of protrusions along the waveguide conducting tube are electromagnetically coupled.

According to some aspects, each set of protrusions 407, 407', 407" formed along the longitudinal extension L1 of the waveguide conducting tube 104 is separated from adjacent sets of protrusions or other surrounding structures by a reduction of the cross section area of the inner wall of the waveguide conducting tube 104 acting to reduce the coupling to adjacent sets of protrusions or other surrounding structures.

According to some aspects, the waveguide section 101 comprises an antenna section 103, the antenna section 103 being arranged to interface with a transmission medium for transmission and reception of RF waveforms.

According to some aspects, the antenna section 103 comprises one antenna 111; 711, 811, 911 for each waveguide conducting tube 104, 704, 804, 904, whereby a radio frequency signal comprised in a radio frequency band passing to or from each antenna 111; 711, 811, 911 via the corresponding waveguide conducting tube 104, 704, 804, 904 is arranged to be electromagnetically filtered According to some aspects, each antenna 711, 811 is formed at a corresponding end part 712, 812 that comprises an opening 713, 813 and a closest set of protrusions 707*b*, 807*b* that form radiators, where the open end 713, 813 is positioned a certain distance D from the closest set of protrusions 707*b*, 807*b*.

According to some aspects, each antenna 911 is formed at a corresponding end part 912 where the closest set of protrusions 907*c* comprises plate parts 909*c* that are tapered and meet the electrically conducting inner wall at the opening 913.

Generally, the present disclosure also relates to array antenna arrangement 100, comprising a waveguide section 101 according to any one of the claims 10-13, where the array antenna arrangement 100 further comprises a feed arrangement 130 adapted to feed the waveguide section 101, enabling each waveguide conducting tube 104; 104*a*, 104*b*, 104*c*, 104*d* to interface with external RF, radio frequency, circuitry 134.

According to some aspects, the waveguide section 101 comprises a plurality of waveguide conducting tubes 104; 104*a*, 104*b*, 104*c*, 104*d*, forming a waveguide array 105, According to some aspects, the waveguide section 101 comprises a at least four waveguide conducting tubes 104; 104*a*, 104*b*, 104*c*, 104*d*, forming a waveguide array 105, According to some aspects, the feed arrangement 130 comprises a multi-layer printed circuit board 131, PCB, that is mounted to a first end 132 of the waveguide section 101, opposite a second end 133 of the waveguide section, where the second end 133 comprises the antenna section 103.

According to some aspects, the PCB 131*a* comprises at least one signal layer 1001*a*, 1001*b* and a ground plane 1002 facing and contacting the waveguide section 101, where the ground plane 1002 comprises at least one aperture 1003, 1004, 1005, 1006, 1011 for each waveguide conducting tube 104, and where said signal layer 1001*a*, 1001*b* comprises at least one feeding conductor 1007 adapted for feeding the apertures 1003, 1004, 1005, 1006 via at least one feed probe 1008.

According to some aspects, the PCB 131*b* comprises at least one signal layer 1101*a*, 1101*b* and a ground plane 1102 facing and contacting the waveguide section 101, where the ground plane 1102 comprises an isolated patch element 1103 for each waveguide conducting tube 104, and where said signal layer 1001*a*, 1001*b* comprises at least one feeding conductor 1104 adapted for feeding each patch element 1103 via at least one feed probe 1105.

According to some aspects, the PCB 131*c* comprises at least one signal layer 1201*a*, 1201*b* and a ground plane 1202 facing and contacting the waveguide section 101, where said signal layer 1201*a*, 1201*b* comprises at least one feeding conductor 1203 connected to at least one electrically conducting feed probe 1204 that extends to the closest set of protrusions 1207*a*, 1207*b*, 1207*c*, 1207*d* and is electrically connected to these protrusion 1207*a*, 1207*b*, 1207*c*, 1207*d*.

According to some aspects, the PCB is connected to radio frequency, RF, circuitry 134.

Generally, the present disclosure also relates to method for manufacturing an array antenna arrangement 100 according to the above, wherein the method comprises:

using S1 3D-printing, either direct or indirect with a printed mold, to manufacture a waveguide section 101 according to the above;

attaching S3 the waveguide section 101 to a multi-layer printed circuit board 131, PCB; and attaching S4 radio frequency, RF, circuitry 134 to the PCB 131.

According to some aspects, the method comprises:

metalizing S2 the 3D-printed object in order to obtain an electrically conducting surface.

The invention claimed is:

1. A waveguide section comprising:

at least one air-filled waveguide conducting tube having a longitudinal extension, each waveguide conducting tube having an electrically conducting inner wall and comprising at least one set of at least two electrically conducting integrally formed protrusions, wherein each protrusion is electrically conducting and comprises a corresponding plate part that is adapted to form a capacitance with at least one other plate part in the same set of protrusions for each set of protrusions, wherein a radio frequency signal passing via a corresponding waveguide conducting tube is arranged to be electromagnetically filtered.

2. The waveguide section according to claim 1, wherein each protrusion comprises a corresponding holding part that connects each plate part to the inner wall and forms an inductance.

3. The waveguide section according to claim 1, wherein the protrusions in each set of protrusions lie in a corresponding common plane, perpendicular to the longitudinal extension of the waveguide conducting tube, and wherein the protrusions in each set of protrusions at least pairwise have the same shape and mirror-symmetrically extend along a corresponding longitudinal extension.

4. The waveguide section according to claim 1, wherein circumferentially adjacent plate parts comprised in a set of protrusions form capacitances.

5. The waveguide section according to claim 1, wherein, in each set of protrusions, the protrusions form opposing pairs that have the same shape and symmetrically extend towards each other from the inner wall.

6. The waveguide section according to claim 1, wherein, in each set of protrusions, the circumferentially adjacent plate parts comprise mutually parallel surfaces.

7. The waveguide section according to claim 1, wherein, in each set of protrusions, the protrusions extend towards a central portion of the waveguide conducting tube.

8. The waveguide section according to claim 1, wherein, for each waveguide conducting tube, a plurality of sets of protrusions are formed along the longitudinal extension of the waveguide conducting tube, such that adjacent sets of protrusions along the waveguide conducting tube are electromagnetically coupled.

9. The waveguide section according to claim 1, wherein each set of protrusions formed along the longitudinal extension of the waveguide conducting tube is separated from adjacent sets of protrusions or other surrounding structures by a reduction of the cross section area of the inner wall of the waveguide conducting tube acting to reduce the coupling to adjacent sets of protrusions or other surrounding structures.

10. The waveguide section according to claim 1, wherein the waveguide section comprises an antenna section, and wherein the antenna section is arranged to interface with a transmission medium for transmission and reception of radio frequency waveforms.

11. The waveguide section according to claim 10, wherein the antenna section comprises one antenna for each waveguide conducting tube, wherein a radio frequency signal comprised in a radio frequency band passing to or from each antenna via the corresponding waveguide conducting tube is arranged to be electromagnetically filtered.

12. The waveguide section according to claim 11, wherein each antenna is formed at a corresponding end part that comprises an opening and a closest set of protrusions that form radiators, wherein the open end is positioned a certain distance from the closest set of protrusions.

13. The waveguide section according to claim 11, wherein each antenna is formed at a corresponding end part, wherein the closest set of protrusions comprises plate parts that are tapered and meet the electrically conducting inner wall at the opening.

14. An array antenna arrangement, comprising:

a waveguide section comprising:

at least one air-filled waveguide conducting tube having a longitudinal extension, each waveguide conducting tube having an electrically conducting inner wall and comprising at least one set of at least two electrically conducting integrally formed protrusions, wherein each protrusion is electrically conducting and comprises a corresponding plate part that is adapted to form a capacitance with at least one other plate part in the same set of protrusions for each set of protrusions, wherein a radio frequency signal passing via a corresponding waveguide conducting tube is arranged to be electromagnetically filtered; and an antenna section, wherein the antenna section is arranged to interface with a transmission medium for transmission and reception of radio frequency waveforms; and a feed arrangement adapted to feed the waveguide section, enabling each waveguide conducting tube to interface with external radio frequency circuitry.

15. The array antenna arrangement according to claim 14, wherein the waveguide section comprises a plurality of waveguide conducting tubes, forming a waveguide array.

16. The array antenna arrangement according to claim 14, wherein the waveguide section comprises at least four waveguide conducting tubes, forming a waveguide array.

17. The array antenna arrangement according to claim 14, wherein the feed arrangement comprises a multi-layer printed circuit board, PCB, that is mounted to a first end of the waveguide section, opposite a second end of the waveguide section, where the second end comprises the antenna section.

18. The array antenna arrangement according to claim 14, wherein the PCB comprises at least one signal layer and a ground plane facing and contacting the waveguide section, where the ground plane comprises at least one aperture for each waveguide conducting tube, and where said signal layer comprises at least one feeding conductor adapted for feeding the apertures via at least one feed probe.

19. The array antenna arrangement according to claim 17, wherein the PCB comprises at least one signal layer and a ground plane facing and contacting the waveguide section, where the ground plane comprises an isolated patch element for each waveguide conducting tube, and where said signal layer comprises at least one feeding conductor adapted for feeding each patch element via at least one feed probe.

20. A method for manufacturing an array antenna arrangement, wherein the array antenna arrangement comprises:

a waveguide section comprising:

at least one air-filled waveguide conducting tube having a longitudinal extension, each waveguide conducting tube having an electrically conducting inner wall and comprising at least one set of at least two electrically conducting integrally formed protrusions, wherein each protrusion is electrically conducting and comprises a corresponding plate part that is adapted to form a capacitance with at least one other plate part in the same set of protrusions for each set of protrusions, wherein a radio frequency signal passing via a corresponding waveguide conducting tube is arranged to be electromagnetically filtered; and an antenna section, wherein the antenna section is arranged to interface with a transmission medium for transmission and reception of radio frequency waveforms; and a feed arrangement adapted to feed the waveguide section, enabling each waveguide conducting tube to interface with external radio frequency circuitry, wherein the method comprises:

using 3D-printing, either direct or indirect with a printed mold, to manufacture the waveguide section;

attaching the waveguide section to a multi-layer printed circuit board; and attaching radio frequency circuitry to the printed circuit board.

* * * * *